US012751586B2

(12) United States Patent
Hibbs

(10) Patent No.: US 12,751,586 B2
(45) Date of Patent: Oct. 6, 2026

(54) PORTABLE TOILET WITH TETHERED AGITATORS

(71) Applicant: Coversan, LLC, Savannah, MO (US)

(72) Inventor: Curtis Randall Hibbs, Savannah, MO (US)

(73) Assignee: Coversan, LLC, Savannah, MO (US)

( * ) Notice: Subject to any disclaimer, the term of this patent is extended or adjusted under 35 U.S.C. 154(b) by 76 days.

(21) Appl. No.: 18/623,480

(22) Filed: Apr. 1, 2024

(65) Prior Publication Data

US 2024/0389803 A1 Nov. 28, 2024

Related U.S. Application Data

(60) Provisional application No. 63/504,557, filed on May 26, 2023.

(51) Int. Cl.
*A47K 17/00* (2006.01)
*A47K 11/02* (2006.01)

(52) U.S. Cl.
CPC ..... *A47K 17/00* (2013.01); *A47K 11/02* (2013.01)

(58) Field of Classification Search
CPC ..... A47K 17/00; A47K 11/02
See application file for complete search history.

(56) References Cited

U.S. PATENT DOCUMENTS 2,859,019 A * 11/1958 O'Neill, Jr. ..... B01F 27/073 416/85
6,138,291 A 10/2000 Kot
11,857,122 B2 1/2024 Hibbs
2007/0039096 A1* 2/2007 Smitherman ..... E03D 9/00 4/661

FOREIGN PATENT DOCUMENTS

CN 111085525 A 5/2020
JP 2001327434 A * 11/2001
JP 2017213295 A 12/2017
JP 2019208818 A 12/2019
KR 101980485 B1 5/2019

OTHER PUBLICATIONS

Translation JP-2001327434-A (Year: 2026).*

(Continued)

*Primary Examiner* — Janie M Loeppke
(74) *Attorney, Agent, or Firm* — Coughlin Law Office LLC; Stuart M. Aller; Daniel J. Coughlin

(57) ABSTRACT

A portable toilet includes a waste material receiving bowl having an inwardly sloping cross-section. The inwardly sloping cross-section has a plurality of angular flat sidewalls structured to direct toilet treatment and waste material solutions towards a storage zone of the bowl. The portable toilet also includes a plurality of agitators tethered within the bowl. The agitators may have a plurality of angular surfaces that aid in the formation of turbulent eddies within the toilet treatment solution. The toilet treatment and waste material solutions disposed within the bowl are agitated or dislodged, respectively, within an interior surface of the bowl by contact with the agitators while the portable toilet is manually oscillated.

19 Claims, 5 Drawing Sheets

(56) References Cited

OTHER PUBLICATIONS

Tang Hanping, Wet-type ultrasonic refining equipment, comprehensive treatment system and method for solid waste, CN111085525A, 9 pages, published on May 1, 2020, Google Patents, machine translation of CN111085525A.
Yuda Akio, Portable bio toilet, JP2017213295A, 9 pages, published on Dec. 7, 2017, Google Patents, machine translation of JP2017213295A.
Nakata Coating Co Ltd, Toilet device, JP2019208818A, 5 pages, published on Dec. 12, 2019, Google Patents, machine translation of JP2019208818A.
Moolim Sanitation, Powdering apparatus of excrements for portable toilet, KR101980485B1, 7 pages, published on May 21, 2019, Google Patents, machine translation of KR101980485B1.

* cited by examiner

PORTABLE TOILET WITH TETHERED AGITATORS

CROSS REFERENCES

This application claims the benefit of U.S. Provisional Application No. 63/504,557, filed 26 May 2023.

REFERENCE TO RESEARCH

Not Applicable.

REFERENCE TO CDS

Not Applicable.

FIELD OF THE INVENTION

The present disclosure relates to waste management devices, and more particularly, to a portable toilet apparatus and method of its use.

BACKGROUND

Toilets generally refer to devices used for the containment and disposal of human waste. Flush toilets use water to facilitate removal of the waste to a processing site, such as a septic system, for its decomposition. Other toilet designs have been implemented to reduce water usage levels required for their operation. Examples of such toilets include composting toilets that process the waste locally and chemical based toilets that use chemicals to deodorize the waste until it can be moved to another location for processing. Bedside toilets, which may also be referred to as commodes, are used to temporarily store waste until disposed of in a septic system or compost pit.

SUMMARY

A portable toilet is disclosed with a waste material receiving bowl having an inwardly sloping cross-section. An agitator may be tethered to the bowl of the portable toilet with a tether made of a flexible material. A handle may be mounted to the bowl. Moving the agitators may stir up a granular treatment and cause a foam to form in a liquid solution held within the portable toilet. Waste is directed downward under the force of gravity, between a plurality of agitators, by the inwardly sloping cross-section of the portable toilet. The waste may be covered and concealed by the plurality of agitators. Movement of the bowl moves the agitators, which are constrained by the tethers, and cleans the inside of the bowl by contacting the plurality of agitators with an interior surface of the bowl.

The above advantages and features are of representative embodiments only and are presented only to assist in understanding the invention. It should be understood that they are not to be considered limitations on the invention as defined by the claims. Additional features and advantages of embodiments of the invention will become apparent in the following description, from the drawings, and from the claims.

BRIEF DESCRIPTION OF DRAWINGS

Aspects are illustrated by way of example, and not by way of limitation, in the accompanying drawings, wherein.

DETAILED DESCRIPTION

Portable toilet 100 is a containment vessel that may be used as a commode. Portable toilet 100 may temporarily store biological waste material for a period until the biological waste material can be dispensed into a septic system or compost pit. The portable toilet 100 may be supported by a portable toilet chair or serve alone as the portable toilet chair. The portable toilet 100 has a bowl 105 with an inwardly sloping cross-section. The bowl 105 may be made of any durable material (e.g., sheet metal, plastic, fiberglass, etc.), or a combination of materials, that are suitable for construction of the portable toilet 100. The bowl 105 may be fitted with a handle 140 that is structured for carrying the portable toilet 100. Handle 140 may pivotally move without falling back into the bowl 105.

Figure 1:
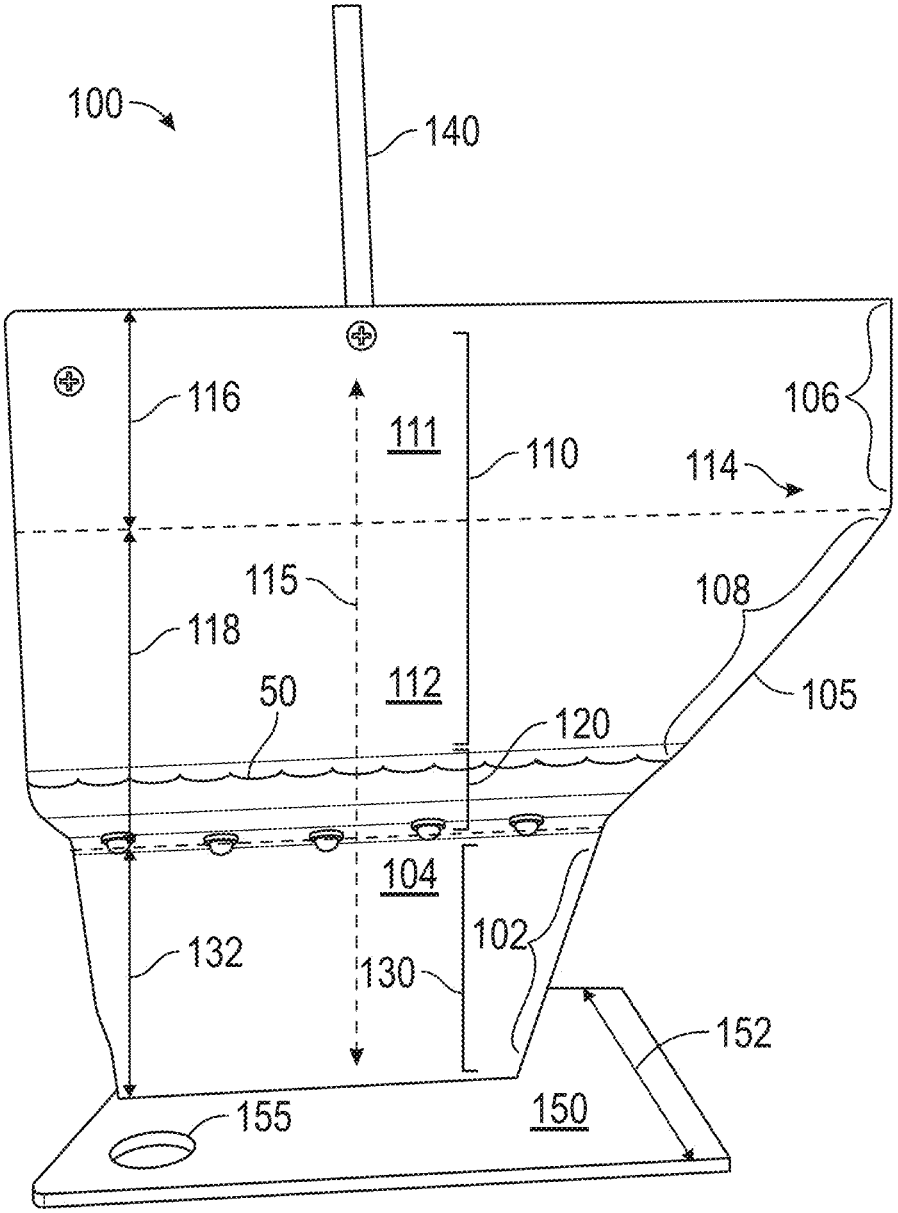
FIG. 1 depicts a side elevation view a portable toilet.

FIG. 1 shows an example for a bowl design of the portable toilet 100. An upper portion 116 of bowl 105 has an opening that may be fitted with a toilet seat (not shown). A lid may be fitted above the toilet seat. The sidewalls of the upper portion 116 are generally sloped at angles of between 80 degrees to 90 degrees. The upper portion 116 has an upper internal cavity that is large and wide. The middle portion 118 has a middle internal cavity that slopes inwardly as a funnel. A lower portion 132 of bowl 105 has a lower internal cavity that is small and narrow. The lower internal cavity in the lower portion 132 is disposed below the upper internal cavity in the upper portion 116. The width of the lower internal cavity is constricted relative to the width of the upper internal cavity which forms a funnel-shaped bowl. The bowl shape directs deposited waste towards a storage zone 130 for concealment.

A front wall 114 within the upper portion 116 of bowl 105 has an upper front wall 106. The upper front wall 106 descends at an angle of between 80 degrees to 90 degrees from horizontal. The upper front wall 106 extends towards and contacts an upper peripheral sidewall 111 within the upper portion 116. The upper peripheral sidewall 111 within the upper portion 116 descends at an angle of between 70 degrees to 90 degrees from horizontal. The upper front wall 106 extends approximately at a right angle from the upper peripheral sidewall 111 to form a corner of bowl 105. The generally flat vertical sidewalls may transition into sloped walls below the upper portion 116 of bowl 105. Sloped walls below the upper portion 116 direct waste towards the storage zone 130 within the lower portion 132 of bowl 105.

A middle peripheral sidewall 112 within a middle portion 118 of bowl 105 descends from the upper peripheral sidewall 111 at an angle of between 70 degrees to 90 degrees from horizontal. The middle peripheral sidewall 112 extends towards and contacts a urine ramp 108 of the front wall 114 within the middle portion 118. The urine ramp 108 descends from the upper front wall 106 at an angle of between 30 degrees to 50 degrees from horizontal. The urine ramp 108 may direct urine released into bowl 105 by the user towards the storage zone 130 in the lower portion 132 of bowl 105.

Figure 2:
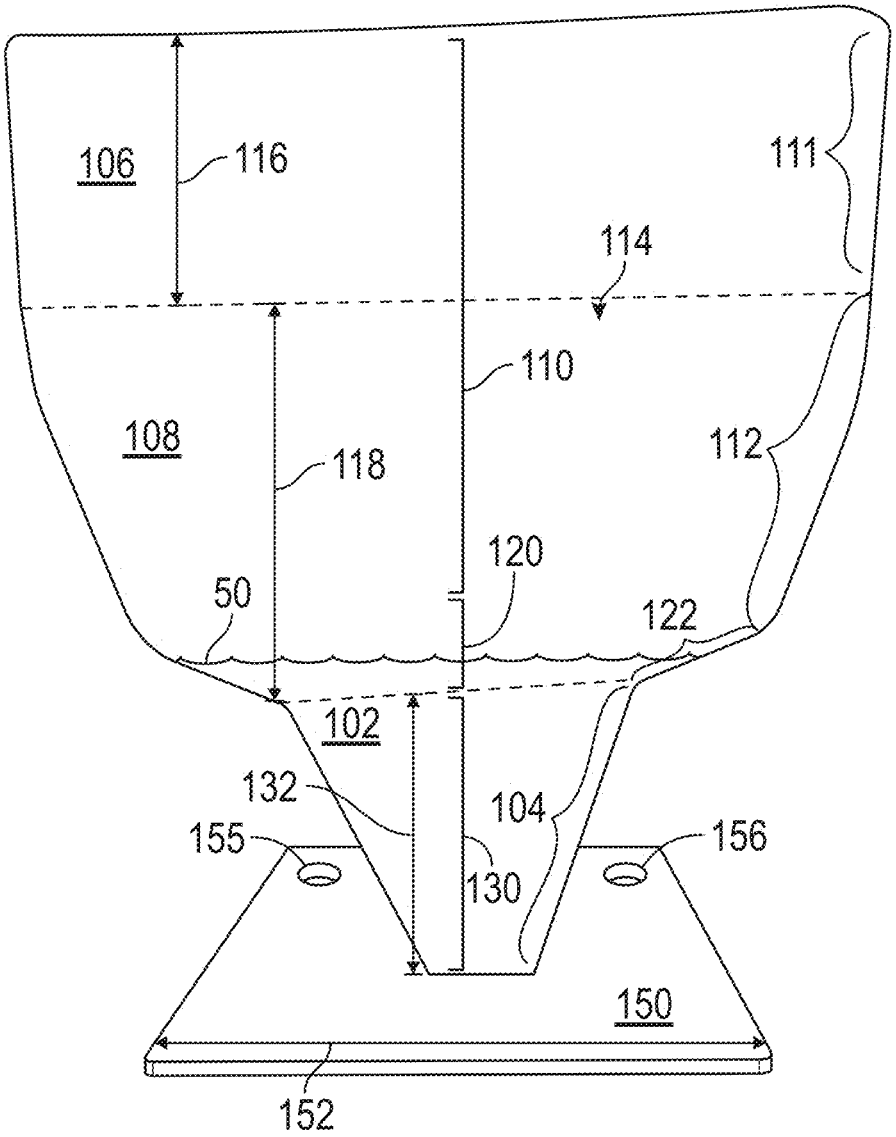
FIG. 2 depicts a front elevation view of the portable toilet of FIG. 1.

A splash zone 110 within the upper portion 116 and the middle portion 118 is shown in FIG. 1 and FIG. 2. The splash zone 110 of bowl 105 provides a displacement distance between a user and the surface of a liquid solution 50 received within bowl 105. The splash zone 110 also positions the user away from deposited waste received and contained within the storage zone 130 in the lower portion 132 of bowl 105.

A mixing zone 120 within the middle portion 118 may have a waste ramp 122 that descends from the middle peripheral sidewall 112 at an angle of between 15 degrees to 30 degrees from horizontal. The waste ramp 122 directs waste deposited into bowl 105 by the user towards the storage zone 130 for storage and containment in the lower portion 132 of bowl 105. The surface of a liquid solution 50 held within mixing zone 120 may function as a receiving "target" area for deposited waste. In one example, mixing zone 120 may have a width or diameter of approximately nine inches. Generally, mixing zone 120 may be between six inches and 12 inches in diameter.

The storage zone 130 of bowl 105 may have a lower front wall 102 that descends from the urine ramp 108 at an angle of between 50 degrees to 80 degrees from horizontal. Additionally, storage zone 130 may have a lower peripheral sidewall 104 that descends from waste ramp 122 at an angle of between 50 degrees to 80 degrees from horizontal. The descending walls of storage zone 130 form a lower internal cavity within bowl 105. Liquid solution 50 may be held within storage zone 130 of bowl 105 for receipt and containment of deposited waste. The storage zone 130 may have a dimension of depth that accommodates the length of an average human-sized fecal waste deposit. In one example, storage zone 130 may have a depth or height of approximately six inches. Generally, storage zone 130 may be between four inches and 12 inches in depth or height. The depth of the storage zone 130 may be a distance that is less than the width or diameter 152 of a base 150 to stabilize the portable toilet 100 in the free-standing position upon the base 150.

The storage zone 130 may be formed with a narrower cross-section, from left to right and front to back, than overlying zones within bowl 105. Dimensions of storage zone 130 may depend on the volume of waste that will be deposited by a subset of users. In one construction, the distance between the peripheral sidewalls of the storage zone 130 may be decreased, but the height of the storage zone 130 is increased to deepen the constricted cavity. In another construction, the distance between the peripheral sidewalls of the storage zone 130 may be increased, but the height of the storage zone 130 is decreased to widen the constricted cavity. Having inverse proportionality between the width and height of the storage zone 130 may maintain a volume of a liquid solution 50 within bowl 105 that is capable of causing a household flush toilet to self-flush when waste contents from the portable toilet 100 are dispensed into the household flush toilet.

Figure 4:
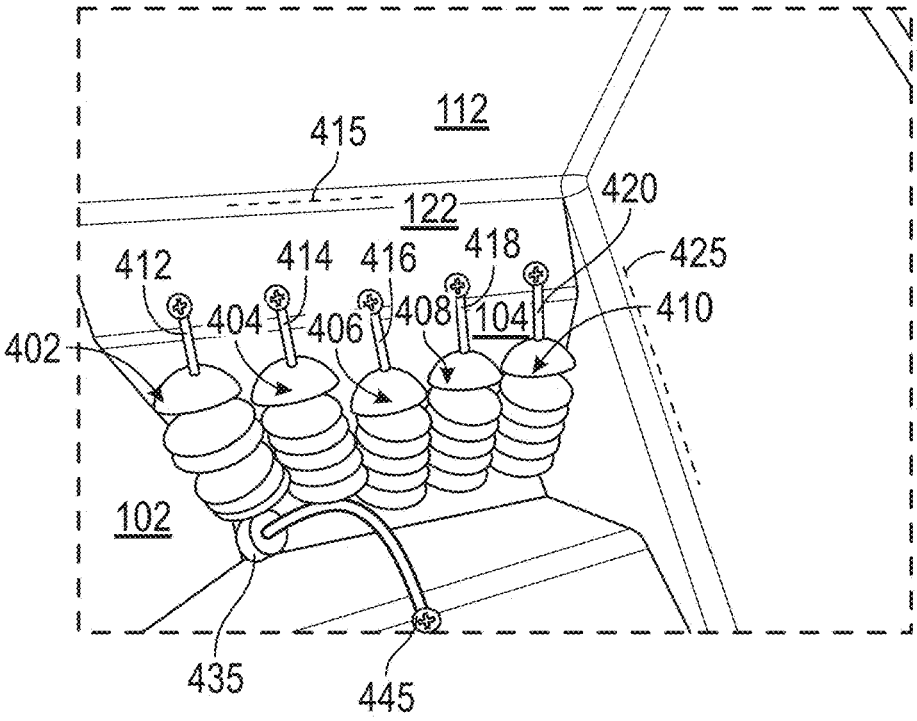
FIG. 4 depicts an interior view of tethered agitators within a bowl of the portable toilet of FIG. 3.

As shown in FIG. 4, a first indicator, which is a liquid solution fill line 415, is disposed at an upper end of the mixing zone 120. The liquid solution fill line 415 may be disposed at or above an upper end of the storage zone 130. More specifically, vertical placement of the liquid solution fill line 415 may be at a position that is above the waste ramp 122 or below the urine ramp 108. The liquid solution fill line 415 indicates the position at which a liquid solution may be filled up to in bowl 105. Placement of the liquid solution fill line 415 vertically within bowl 105 may be based on the width or diameter 152 of the base 150. Alternatively, the width or diameter 152 of base 150 may depend on dimensions that correspond with a surface area of a liquid solution filled to the liquid solution fill line 415.

Size dimensions between the mixing zone 120 and the storage zone 130 may give a ratio, by volume, that reduces the amount of liquid solution 50 necessary to capture deposited waste and disperse a toilet treatment within the liquid solution 50. As a result, the amount of toilet treatment added to the bowl 105 for waste treatment, waste concealment, or both, may be substantially less than the amount of toilet treatment utilized in existing toilets. The ratio between the mixing zone 120 and the storage zone 130 may be between 1:10 to 9:10 by volume, or further between 1:4 to 4:5 by volume, or more preferably between 1:3 to 2:3 by volume.

As shown in FIG. 2, the liquid solution 50 within mixing zone 120 has a wide but shallow cross-section, whereas the liquid solution 50 within storage zone 130 has a narrow but deep cross-section. Placement of the liquid solution fill line 415 above the waste ramp 122 creates a larger, receiving "target" area for capturing deposited waste. Since the storage zone 130 is narrower below the waste ramps, then less liquid solution 50 may be added to fill the bowl 105 to the liquid solution fill line 415 than if the storage zone 130 was not restricted in width. The economical use and portability of the portable toilet 100 is enhanced by having a storage zone 130 that is narrowly tapered to minimize the total amount of toilet treatment and weight of liquid solution 50.

As shown in FIG. 4, a second indicator may be disposed above the first indicator to indicate a waste solution fill line 425. Placement of the waste solution fill line 425 vertically within bowl 105 may be based on the dimensions of the base 150. Placement of the second indicator may be within a transition zone disposed between a peripheral sidewall and a back slope on a back wall of the bowl 105. When a waste solution fills the bowl 105 up to the waste solution fill line 425, which may occur after repeated uses, the user is given a visual indication that the waste solution should be dispensed from bowl 105 of the portable toilet 100.

The volume of the liquid solution 50 or waste solution within bowl 105 of the portable toilet 100 may be of an amount that automatically flushes a household flush toilet when dispensed from the portable toilet 100 into a household flush toilet. The volume of contents within the portable toilet 100 at the liquid solution fill line 415 or waste solution fill line 425 may total between 0.25 to 5 gallons, or further between 1 to 3 gallons, or most preferably between 0.75 to 1.5 gallons.

A sidewall of storage zone 130 may have a toilet treatment fill line (not shown). The toilet treatment fill line may serve as a third indicator for how much toilet treatment a user may add to the bowl 105. The position of the toilet treatment fill line within storage zone 130 may be based on toilet treatment types selected and amounts of toilet treatment that are quantified in relation to the amount of liquid solution 50 used. A correlation between the toilet treatment fill line and the liquid solution fill line 415 may optimize a toilet treatment to liquid solution ratio for accurate dosing of an amount of toilet treatment, such as a reagent, foam, or reactive formulation, which may be added to the bowl 105. An example of a toilet treatment that that may be utilized in portable toilet 100 to produce a concealing foam is described in U.S. Pat. No. 11,441,108, the description of which is hereby incorporated by reference.

The amount of toilet treatment added into the portable toilet 100 may be considerably less than amounts of toilet treatments used in existing toilets. This advantage may be due to the portable toilet 100 having a deeper, constricted cavity within the storage zone 130. The constricted cavity may cause the toilet treatment to be concentrated within a smaller volume of liquid solution 50, rather than being diluted within a greater volume of liquid solution that may be found in existing toilets. Additionally, interaction between the toilet treatment and waste contents contained within storage zone 130 may be more intimate due to the constricted cavity.

The toilet treatment may comprise toilet chemicals, toilet deodorizer, multi-purpose surface cleaner, such as Clorox®, chemical sanitizer, mildew or mold remover, enzymes, freshners, or other liquid detergent blend that may comprise acids and surfactants to clean, disinfect, and deodorize the portable toilet.

Containment of waste contents deposited into bowl 105 within the lower internal cavity aids in concealment of the waste contents held in the storage zone 130. Waste contained within storage zone 130 may be concealed by buoyant agitators or toilet treatment disposed within the mixing zone 120. Overlying floating agitators or toilet treatment, such as a light, semi-dense, or dense foaming agent, disposed within the mixing zone 120 contribute to the concealment of the waste contents.

The foaming agent may comprise sodium lauryl ether sulfate, sodium lauryl sulfate, ammonium lauryl sulfate, ammonium laureth sulfate, PEG-80 Glyceryl cocoate, sodium cocoyl isethionate, codium coco sulfate, coco glucoside, decyl glucoside, cocamidopropyl betaine, sodium lauryl sulfoacetate, caprylyl capryl glocoside, sodium A02-40, lauramidorpropyl betaine, disodium laureth sulfosuccinate, disodium cocoamphodiacetate, cocoamide monoethanolamine, Dodecylbenzenesulfonic acid, Vio-Terge® AS 90, Plantapon® LGC Sorb, Montanov™ 68, sodium lauroyl isethionate, triethanolamine, saponins, cobalt, detergent(s), a shaving cream, or a synthetic detergent soap (such as syndet bars from Zest™, Ivory™, Dove™, or other suppliers).

Synthetic Detergent (syndet) bars may be chipped and ground to provide more surface area. Syndet bars having a waxy texture may be more easily granulized or powdered. Synthetic detergent soaps are commercially available, such as syndet bars from Zest™, Ivory™, Dove™, or other suppliers. In the example of Zest™, the lathering and gelatinizing effects mimicked the qualities of natural soap made from a hydrogenated oil and lye. The soap may be made from hydrogenated soybean oil.

In some cases, the foaming agent may comprise a sodium carbonate, sodium percarbonate, hydrogen peroxide, or other oxidizing agent. Sodium based detergents, such as used in a dishwasher, clothes washer, or car wash may have better gelatinizing capabilities than laundry detergents. The foaming agent may comprise a blowing agent that reacts in the presence of waste, for example, due to a change of pH or the presence of organic material.

The liquid may comprise one, or more, foam stabilizing agents, thickening agents, and/or co-surfactants to increase the quantity of foaming and/or the lifespan of the foam. The foam stabilizing agent may be selected from the group consisting of polymeric emulsifiers, polymeric foam stabilizers and mixtures thereof. One or more blowing agents may be used with one or more surfactants, foam stabilizing agents, thickening agents, and/or co-surfactants to form a foam on or in the liquid.

The liquid may comprise a sufficient amount of a foaming agent, comprising surfactants for stabilizing the foam or blowing agents to disperse a mass of small bubbles on or in the liquid. Agitating the liquid may create a foam on or in the liquid. The foam may be liquid-like or semi-solid. The liquid may be comprised of one, or more, of a dyed water, a foaming detergent, a foaming agent, an opaque toilet treatment, or other toilet treatment solution that aids in the treatment and concealment of waste contents.

Figure 3:
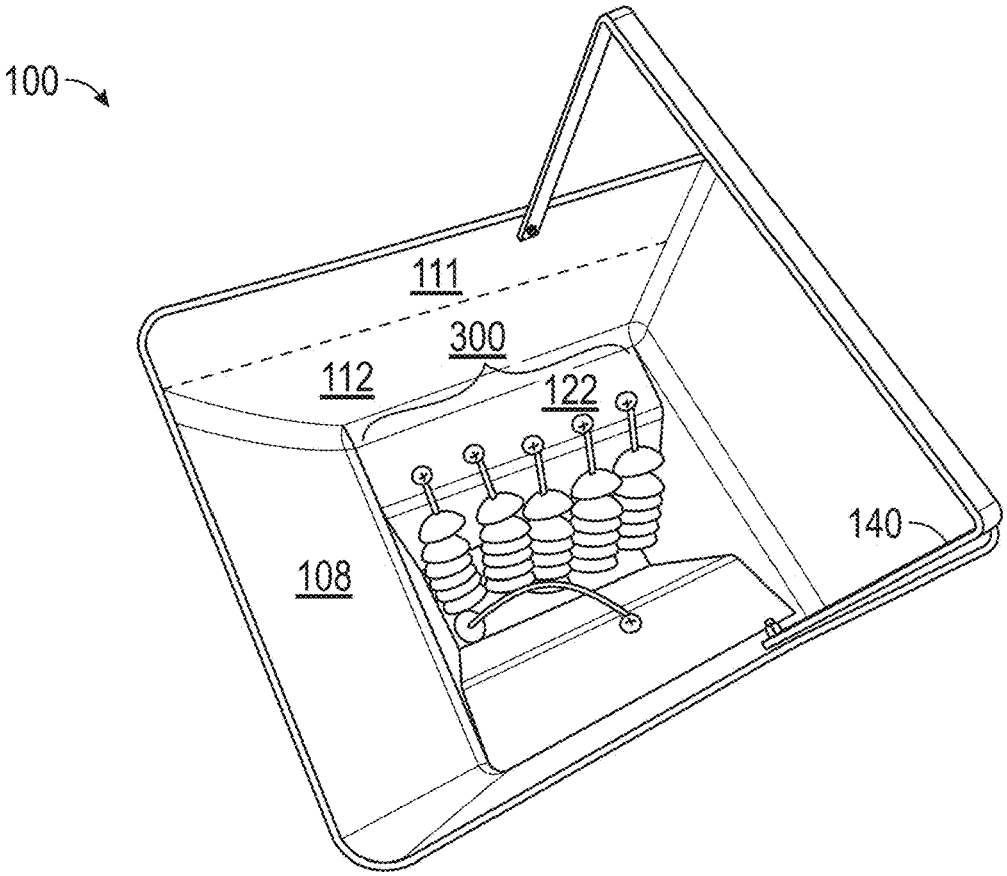
FIG. 3 depicts top-side perspective view of the portable toilet of FIG. 1.

A single agitator or a plurality of agitators may be disposed within an interior of bowl 105. As shown in FIG. 3, a plurality of agitators 300 are disposed within bowl 105 without a liquid solution. The plurality of agitators 300 may be comprised of any buoyant or non-buoyant material (e.g., metal, plastic, fiberglass, polymer material, wood, solid toilet treatment formulation, etc.) that is suitable for construction of the agitators. The plurality of agitators 300 may be structured to agitate a liquid treatment, granular treatment, a combination treatment, and waste received into bowl 105. Therefore, the toilet treatment and waste are not necessarily separated but are in communication with (i.e., touching) components of the portable toilet, such as the agitators.

Agitators 402, 404, 406, 408, 410 shown in FIG. 4 are referred to in general as the plurality of agitators 300, as previously shown in FIG. 3. Agitators 402, 404, 406, 408, 410 may induce turbulence within liquid solution 50 as a stream of the liquid solution is added into bowl 105. Mixing of a toilet treatment within the liquid solution 50 may be further enhanced when bowl 105 is swiftly oscillated back and forth or swiveled about a vertical axis 115 of the portable toilet 100. Agitators 402, 404, 406, 408, 410 may aid in the enhanced mixing by inducing turbulent eddies within the liquid solution 50 as bowl 105 is oscillated or swiveled.

As an example, in preparation for a waste deposit, a pre-measured liquid-soluble packet containing a reactive formulation, such as a granular toilet treatment, may be easily and efficiently dissolved inside the portable toilet 100 as the liquid solution 50 is poured over the agitators or oscillated by movement of the bowl 105. The oscillating motion may cause the plurality of agitators 300 to move in a counter-current flow direction to the flow direction of the liquid solution 50 to cause dispersal and mixing of a toilet treatment combined with the liquid solution 50.

As shown in FIG. 4, agitators 402, 404, 406, 408, 410 are connected to tether attachments 412, 414, 416, 418, 420, respectively, which are fastened on one side of bowl 105 at a lower end of the waste ramp 122 within the mixing zone 120. The tether attachments may be connected to any interior surface of the bowl 105 or may be inserted through a sidewall of the bowl 105 for attachment. Alternatively, each of the tether attachments 412, 414, 416, 418, 420 may be fastened in an alternating fashion to opposing sidewalls of bowl 105 so that each of the plurality of agitators are mounted in a crisscross fashion.

Figure 5:
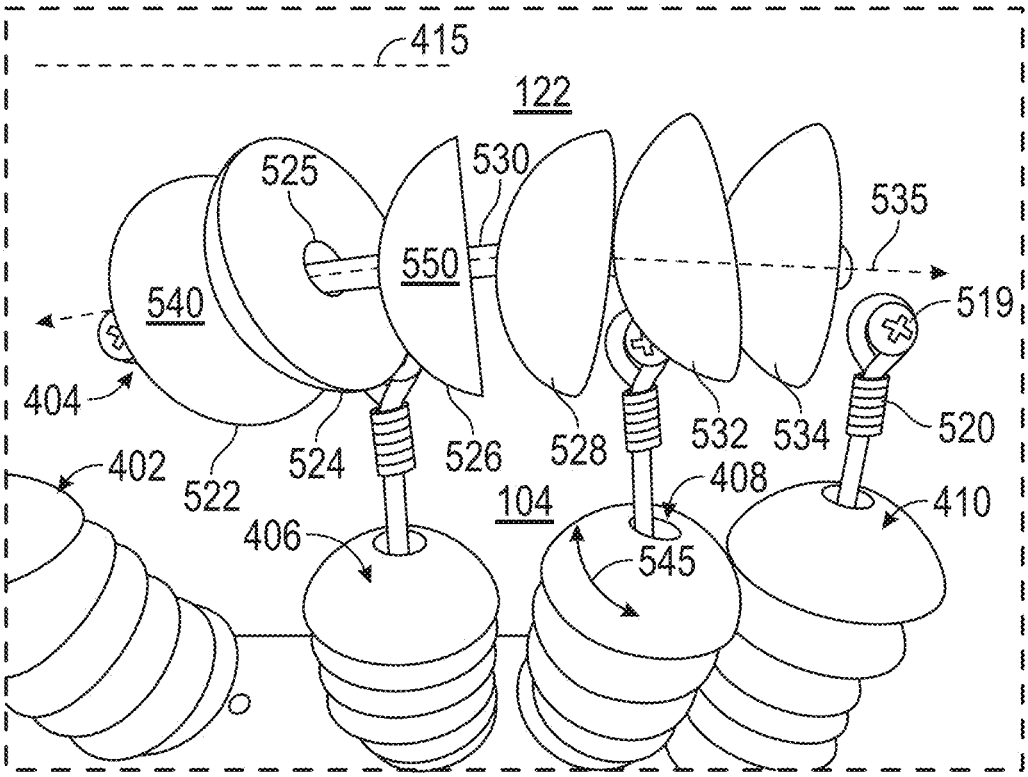
FIG. 5 depicts a close-up view of an agitator within the bowl of FIG. 4 which is pivoted ninety degrees from vertical.

The plurality of agitators 300 may be mounted with a corresponding tether along a sidewall of the bowl 105. As shown in FIG. 5, tether 530 connected to the waste ramp 122 is molded from a flexible material. The tether 530 may be made of any buoyant or non-buoyant material (e.g., metal wire, plastic cord, polymer material, elastic material, rope, etc.) that is suitable for construction of the tether 530. In a molded design, the tether 530 and agitating members, discussed below, may be made of a one-piece, flexible material that allows bending or twisting of the tether 530 during oscillations of the portable toilet 100.

A swivel attachment 520 may connect an agitator to a swivel mount 519. As shown in FIG. 5, swivel mount 519 is fastened directly to the lower end of waste ramp 122. Alternatively, the swivel mount 519 may be fastened to a solid attachment point extending out from a sidewall of bowl 105. The swivel mount 519 or swivel attachment 520 may increase the agitating motion of each of the plurality of agitators 300 as the portable toilet 100 oscillates. Rotational movement of each of the plurality of agitators 300 within the mixing zone 120 may be enhanced with a swivel attachment 520 that turns on swivel mount 519.

Each agitator 402, 404, 406, 408, 410 may have a single or a plurality of agitating members disposed on a corresponding tether. An agitating member may contact the liquid solution 50 and toilet treatment to mix the two components together when the liquid solution 50 is poured over the agitators, or when the portable toilet 100 is oscillated with both components being combined.

As shown in FIG. 5, agitator 404 includes agitating members 522, 524, 526, 528, 532, 534 mounted on tether 530. A first agitating member mounted on the tether 530 may overlap a second agitating member, in a stacked orientation, along the longitudinal axis of the tether 530. The agitating members may be fixed to the tether or be all of one piece with the tether. In the example shown, tether aperture 525 is disposed through a center of an agitating member for mounting of the agitating member on tether 530. Each agitating member 522, 524, 526, 528, 532, 534 may have a tether aperture which also allows each agitating member to rotate freely (movement arrow 545) about a longitudinal axis 535 of tether 530. This rotation (movement arrow 545) may occur independently from a separate rotating agitating member. Agitating members 522, 524, 526, 528, 532, 534 may rotate at least 45 degrees from a first orientation when a liquid solution 50 or waste is deposited thereon causing an imbalance of the agitating member upon the tether 530. This rotation works to further conceal waste towards the storage zone 130 disposed below the liquid solution fill line 415.

Flat surfaces of the agitating members may aid in the formation of turbulent eddies within the liquid solution 50. As shown in FIG. 5, agitating members 522, 524, 526, 528, 532, 534 resemble spheres cut in half. Each of the agitating members-shaped as half-rounded spheres—may have a primary surface 540 that is flat which is generally perpendicular to a longitudinal axis 535 of the tether 530. Sharp angular surfaces may create turbulence when a stream of liquid solution is poured over agitating members 522, 524, 526, 528, 532, 534. The angular surfaces may also aid in mixing toilet treatments with the liquid solution 50 during agitation. A secondary surface 550 may be curved away from the primary surface 540 to allow liquid solution 50 that is in turbulence to flow smoothly back together without substantial splashing within a splash zone 110 of the portable toilet 100. Agitating members 522, 524, 526, 528, 532, 534 can be of any number and structured with various shapes and surfaces. The purpose of the angular structure is to form a plurality of turbulent eddies within liquid solution 50 when the liquid solution 50 is either poured into the bowl 105 or oscillated within the portable toilet 100 about the vertical axis 115.

The agitating members may be made of any buoyant or non-buoyant material (e.g., metal, plastic, fiberglass, polymer material, wood, solid toilet treatment formulation, etc.) that is suitable for construction of the members. The agitators 402, 404, 406, 408, 410 may be coated with treatment agents, such as a fragrance, dye, deodorizer, anti-bacterial, anti-septic, anti-biologic and/or organic treatment. The treatment agent may disperse from the agitator within the liquid solution 50 received into the bowl 105. As shown in FIG. 5, agitating members 522, 524, 526, 528, 532, 534 are made from the same material as the tether 530. Agitating members 522, 524, 526, 528, 532, 534 may be impregnated with the toilet treatment. Alternatively, agitating members 522, 524, 526, 528, 532, 534 may be made completely out of a sold toilet treatment.

For example, agitating members 522, 524, 526, 528, 532, 534 may be made of a solid toilet treatment, such as compressed soaps or other treatment formulation that is utilized to conceal, treat, or otherwise cover waste deposited within the portable toilet 100. The toilet treatment may disperse upon contact with the liquid solution 50. Agitating members 522, 524, 526, 528, 532, 534 may be porous, thereby allowing the liquid solution within the bowl to enter the agitating members through one or more pores and dissolve a portion of the treatment formulation. Therefore, agitators 402, 404, 406, 408, 410 or each of the agitating members 522, 524, 526, 528, 532, 534 may be periodically replaced when the components of the agitator reach a minimum percentage of peak deterioration. The dissolution or decay over time of the reagent material or solid toilet treatment may serve as a visual indication that the agitator needs to be replaced. The minimum percentage of peak deterioration indicating that an agitator or an agitating member of the agitator needs replaced may be between 50% to 100% or further between 60% to 90%, or more preferably between 75% to 85%.

Agitating members 522, 524, 526, 528, 532, 534 may be buoyant or non-buoyant within the liquid solution 50 received by bowl 105. Without a liquid solution 50 received into bowl 105, a buoyant agitator having an agitating member which is a half-rounded sphere-having a semi-spherical shape—may be positioned by gravity where the primary surface 540, which is flat and facing downwards, is generally perpendicular to a vertical axis 115 of the portable toilet 100. Alternatively, the primary surface 540 may be mounted to face upwards in said scenario. With a liquid solution 50 received into bowl 105, the buoyant agitator having an agitating member that is a half-rounded sphere may be positioned by buoyancy where the primary surface 540, which is flat and facing outwards, is generally perpendicular to a horizontal axis of the portable toilet 100. Swiveling the portable toilet about a vertical axis of the portable toilet induces turbulence within the liquid solution 50 by interactions between the moving liquid solution and the agitating members. When utilizing buoyant agitating members mounted to the waste ramp 122, the agitator may float horizontally within liquid solution at a vertical interface between the mixing zone 120 and storage zone 130. This vertical interface may exist approximately where the waste ramp 122 transitions into the lower peripheral sidewall 104.

As previously discussed above, the plurality of agitators 300 may be buoyant or semi-buoyant within a liquid solution 50 received into the bowl. Such agitators may help conceal solid waste. When buoyant, the plurality of agitators 300 shown in FIG. 3 may cover up to 75% or more of a top surface area of liquid solution 50 filling the mixing zone 120. The concealment coverage area may at least be 25% of a top surface of a liquid solution within the bowl 105, or more preferably at least 50% of the top surface of the liquid solution 50 within the bowl 105, or most preferably up to 75% of the top surface of the liquid solution 50 within the bowl 105. This concealment coverage provided by the agitators may give the advantage of concealing waste stored within storage zone 130. In addition, buoyant agitators floating within the vertical interface between the mixing zone 120 and storage zone 130, or the vertical interface between the surface of the liquid solution 50 and the upper internal cavity of bowl 105, may aid in dispersing a reactive reagent within the liquid solution 50 or cleaning an interior surface of the bowl 105 upon application of a swiveling movement to portable toilet 100 by a user.

At least one of the plurality of agitators 300 may be an agitator 435 that is non-buoyant. Agitator 435 may be structured as those agitators previously discussed. Alternatively, the agitator may be made of a dense chain with links that are coated or non-coated. Heavy, but flexible chains may easily work to clean an interior surface of bowl 105 when the portable toilet 100 is manually oscillated back and forth. As shown in FIG. 4, agitator 435 is attached to a surface of the waste ramp 122 by tether attachment 445. Such placement may allow agitator 435 to more easily slide past ends of buoyant agitators attached on an opposing sidewall of waste ramp 122. In one example, where the toilet treatment utilized is a foam, a single or plurality of non-buoyant agitators may be disposed inside the bowl 105. One reason to have only non-buoyant agitator(s) is that foam treatments may effectively conceal the waste held in liquid solution within storage zone 130 disposed below.

Base 150 may be attached to the bottom of bowl 105 to serve as a platform for the portable toilet 100. Base 150 may be structured to support the portable toilet 100 in a free-standing position. To support the portable toilet 100 in a free-standing position, base 150 may have a width or diameter 152 that is at least the width or diameter of the mixing zone 120 of the bowl 105. In other words, the width or diameter 152 of the base 150 may be equal to or greater than a width or diameter between the waste ramps disposed in the middle portion 118 of bowl 105. As a result, the surface area covered by base 150 may correspond substantively equal with the surface area of a liquid solution 50 filled to the liquid solution fill line 415, or the surface area of waste filled to the waste solution fill line 425. Alternatively, the surface area of base 150 may be greater than an area covered by a surface of liquid solution or waste within the mixing zone 120.

In one example, base 150—a floor engagement member—may be a plate that is circular, oval, square or rectangular shaped. Base 150 may be mounted to the bottom of storage zone 130. In another example, base 150 may be circular or oval-shaped and comprise a vertical support wall that descends downward from bowl 105. Base 150 may be mounted to the middle portion 118 or the upper portion 116 of bowl 105. In yet another example, base 150 for the portable toilet 100 may comprise vertical legs mounted to bowl 105 which are disposed about a perimeter corresponding to a surface perimeter of the liquid solution fill line 415 or waste solution fill line 425. The width or diameter 152 of the base 150 may have a length that is greater than the height of the storage zone 130. In one example, base 150 may have a width or diameter 152 of approximately nine inches. Generally, base 150 may be between six inches and 12 inches in diameter.

As shown in FIG. 1, the base 150 may be a flat plate with a gripping member 155. Portable toilet 100 mounted with base 150 forms an hourglass or wineglass shape that gives stability to portable toilet 100 placed in a free-standing position. As shown in FIG. 2, gripping members 155, 156 are provided to assist either left-handed or right-handed users in preventing spills when tilting the base 150 of the portable toilet 100 to dispense a waste solution from the bowl 105. Positioning gripping member 155, 156 at a back corner of the base 150 helps the user to grip and tilt the base 150, while grasping the bowl 105 or handle 140 with the other hand, to pour the waste solution from a front corner of the bowl 105. During the pouring action, the corner disposed between the upper peripheral sidewall 111 and the front wall 114 may serve as a funnel to guide the waste solution towards the opening at a top end of bowl 105.

Figure 6:
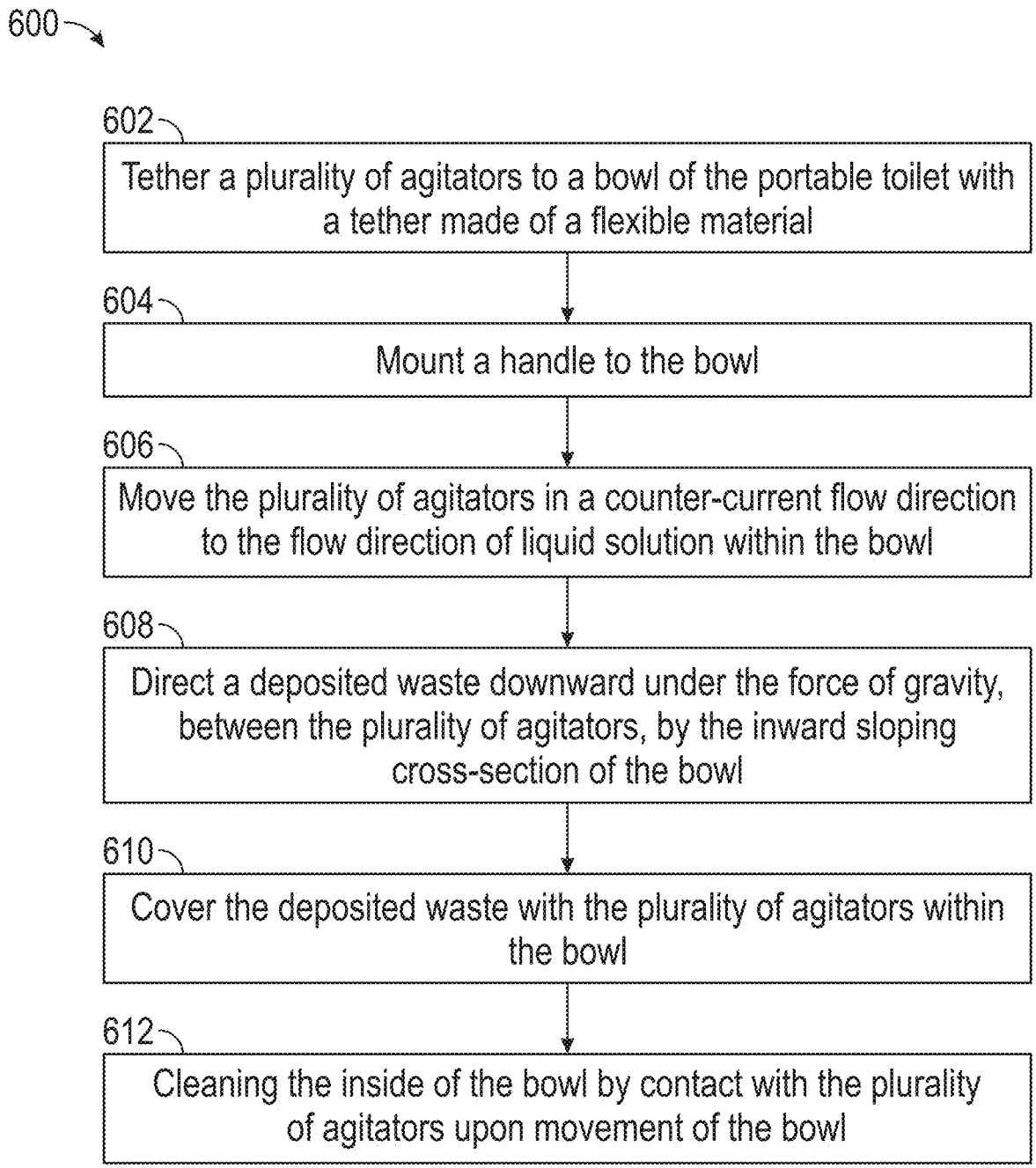
FIG. 6 depicts a flowchart of a method for treating waste within a portable toilet with a plurality of agitators.

Treating waste within a portable toilet by method 600 is shown in FIG. 6. A plurality of agitators are tethered to a bowl of the portable toilet with a tether made of a flexible material, according to step 602. A handle is mounted to the bowl of the portable toilet, according to step 604. If the portable toilet is utilized as a bedside commode, then the handle provides a convenient way to transport the portable toilet from a toilet chair to dispense and rinse waste held within the bowl. The plurality of agitators are moved in a counter-current flow direction to the flow of liquid solution, according to step 606. Deposited waste is directed downward, between the plurality of agitators, by the inwardly sloping cross-section of the portable toilet under the force of gravity, according to step 608. The deposited waste is covered with the plurality of agitators, according to step 610. An inside of the bowl is cleaned upon movement of the portable toilet by contacting the plurality of agitators with the inside of the bowl, according to step 612.

Optionally, the method may include depositing a toilet treatment into the bowl of the portable toilet before or after dispensing a liquid solution into the bowl. Upon filling a liquid solution within the bowl, up to a first indicator, the plurality of agitators may elevate. Turbulence induced by pouring the liquid solution over the plurality of agitators or moving the plurality of agitators with manual oscillation of the portable toilet will disperse the toilet treatment throughout the liquid solution. The portable toilet may be oscillated by rocking or moving the portable toilet from side to side or by rotating the portable toilet, as if on a swivel, about a generally vertical axis. This oscillating movement may be accomplished by the user when grasping the handle or the base or bowl of the portable toilet. When oscillated, the plurality of agitators may move in a counter-current flow direction to the flow direction of the liquid solution.

Additionally, waste directed downward through a plurality of agitators may be stored temporarily for a period within the storage zone. Deposited waste encountering the plurality of agitating members disposed on a tether of the agitator may cause an imbalance of at least one of the agitating members. This imbalance may cause at least one agitating member to be rotated, by the force of gravity, at an angle greater than 45 degrees about a longitudinal axis of the tether. Therefore, the deposited waste becomes concealed within the storage zone by the agitating member.

Further, the portable toilet may be oscillated to dislodge waste that is temporarily stored within the storage zone of the toilet. A detergent can be dispensed into the bowl to help release waste from interior surfaces of the portable toilet. When oscillating, the mixing zone of the bowl is cleaned by at least one of the plurality of the agitators that is buoyant. In addition, the storage zone of the bowl may be cleaned with at least one agitating member that is non-buoyant during movement of the toilet. Therefore, the deposited waste, which may be a treated waste, is loosened and dislodged from an interior surface of the bowl so that it can be dispensed from the bowl. This may eliminate the user from having to hand-scrub and wipe interior surfaces of the portable toilet.

An overview of one process that utilizes the portable toilet from beginning to end is now summarized. The plurality of agitators may be tethered to the bowl of the portable toilet with a tether made of a flexible material. A toilet treatment may be deposited into the bowl. A liquid solution may be added to the bowl up to a liquid solution fill line disposed in the bowl. The plurality of agitators may be buoyant within the liquid solution held within the bowl. The plurality of agitators may be moved in a counter-current flow direction to a flow path of the liquid solution as the portable toilet is swiveled by a user grasping the handle and base. The toilet treatment may be agitated and dispersed by turbulence formed within the liquid solution with horizontal movement of the plurality of agitators. Inwardly sloping walls of the bowl may direct a waste deposit downward between the plurality of agitators by the force of gravity into a storage zone. The storage zone may encompass a constricted cavity that is deeper than it is wide to contain the waste deposited. Waste deposited within the bowl and contained within the storage zone may be covered by the plurality of agitators and concealed by the agitated toilet treatment. An indicator in the bowl may indicate a total volume of deposited waste that can automatically flush a household toilet when dispensed from the bowl. The portable toilet may be removed from a tub mounted on a toilet chair. A disinfectant may be sprayed onto the agitators and an interior surface of the bowl. The inside surface of the bowl may be cleaned with contact from the plurality of agitators upon movement of the bowl and turbulence created by pressurized water sprayed onto the opposing sloped walls of the bowl. The waste contents held within the bowl may be dispensed into a household flush toilet. An operator may grasp a base and handle of the portable toilet and tilt the portable toilet to pour the waste contents from the portable toilet into the household flush toilet.

It is understood that the invention is not confined to the particular construction and arrangement of parts herein described. That although the drawings and specification set forth a preferred embodiment, and although specific terms are employed, they are used in a description sense only and embody all such forms as come within the scope of the following claims.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims.

For the convenience of the reader, the above description has focused on a representative sample of all possible embodiments, a sample that teaches the principles of the invention and conveys the best mode contemplated for carrying it out. Throughout this application and its associated file history, when the term "invention" is used, it refers to the entire collection of ideas and principles described; in contrast, the formal definition of the exclusive protected property right is set forth in the claims, which exclusively control. The description has not attempted to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. A list of items does not imply that any or all of the items are mutually exclusive, nor that any or all of the items are comprehensive of any category, unless expressly specified otherwise. In many cases, one feature or group of features may be used separately from the entire apparatus or methods described. Many of those undescribed variations, modifications and variations are within the literal scope of the following claims, and others are equivalent.

I claim:

1. A portable toilet comprising:

a bowl; and a plurality of buoyant agitators tethered to the bowl.

2. The portable toilet of claim 1, further comprising:

a tether that is flexible and mounted to a sidewall of the bowl, wherein the plurality of buoyant agitators are tethered to the bowl with the tether.

3. The portable toilet of claim 2, further comprising:

a plurality of agitating members structured to rotate independently around the tether of a first buoyant agitator.

4. The portable toilet of claim 3, wherein at least one agitating member is comprised of a material that dissolves into a liquid solution.

5. The portable toilet of claim 3, wherein the plurality of agitating members are semi-spherical.

6. The portable toilet of claim 1, further comprising:

at least one non-buoyant agitator tethered to the bowl.

7. The portable toilet of claim 1, wherein the plurality of buoyant agitators are structured to form turbulent eddies within a liquid solution upon swiveling the bowl mounted with a handle about a vertical axis.

8. A portable toilet comprising:

a bowl;

a tether that is flexible and mounted to the bowl; and a plurality of agitating members mounted to the tether.

9. The portable toilet of claim 8, wherein the plurality of agitating members are buoyant.

10. The portable toilet of claim 8, wherein the bowl further comprises:

a mixing zone that is an internal cavity disposed vertically in a middle portion of the bowl;

a storage zone that is an internal cavity disposed vertically in a lower portion of the bowl and is constricted relative to the mixing zone; and wherein the tether is mounted to the bowl within the middle portion of the bowl.

11. The portable toilet of claim 10, wherein the plurality of agitating members are structured to cover between 25% to 75% of a top surface area of a liquid solution within the storage zone.

12. The portable toilet of claim 10, further comprising:

a floor engagement member mounted to the bowl, having a width and depth that is at least as large as the width and depth of the mixing zone.

13. A portable toilet comprising:

a bowl comprising:

a mixing zone that is an internal cavity disposed vertically in a middle portion of the bowl; and a storage zone that is an internal cavity disposed vertically in a lower portion of the bowl and is constricted relative to the mixing zone;

a floor engagement member mounted to the bowl, having a width and depth that is at least as large as the width and depth of the mixing zone; and a plurality of buoyant agitators tethered to the bowl that float in a vertical interface between the mixing zone and the storage zone within a liquid solution.

14. The portable toilet of claim 13, the bowl further comprising:

an upper portion having:

an upper peripheral sidewall disposed at an angle of between 80 degrees to 90 degrees from horizontal;

an upper front wall disposed at an angle of between 80 degrees to 90 degrees from horizontal and extending at an approximately right angle from the upper peripheral sidewall;

the middle portion having:

a middle peripheral sidewall disposed at an angle of between 70 degrees to 90 degrees from horizontal;

a urine ramp descending from the upper front wall at an angle of between 30 degrees to 50 degrees from horizontal;

the mixing zone having:

a waste ramp descending from the middle peripheral sidewall at an angle of between 15 degrees to 30 degrees from horizontal;

the lower portion having:

a lower front wall descending from the urine ramp at an angle of between 50 degrees to 80 degrees from horizontal; and a lower peripheral sidewall descending from the waste ramp at an angle of between 50 degrees to 80 degrees from horizontal.

15. The portable toilet of claim 13, wherein a ratio of the mixing zone to the storage zone is 1:10 to 9:10 by volume.

16. The portable toilet of claim 15, wherein the ratio of the mixing zone to the storage zone is further between 1:4 to 4:5 by volume.

17. The portable toilet of claim 16, wherein the ratio of the mixing zone to the storage zone is further between 1:3 to 2:3 by volume.

18. The portable toilet of claim 13, further comprising:

an indicator disposed within the bowl, wherein the total volume of contents within the bowl at the indicator is between 0.25 to 1.5 gallons.

19. The portable toilet of claim 13, wherein the plurality of buoyant agitators are structured to cover between 25% to 75% of a top surface area of the liquid solution in the vertical interface.

* * * * *